US005207731A

United States Patent [19]

Bukoschek

[11] Patent Number: 5,207,731

[45] Date of Patent: May 4, 1993

[54] ELECTRIC SHAVER

[75] Inventor: Romuald L. Bukoschek, Klagenfurt, Austria

[73] Assignee: U.S. Philips Corp., New York, N.Y.

[21] Appl. No.: 821,213

[22] Filed: Jan. 16, 1992

[30] Foreign Application Priority Data

Jan. 18, 1991 [AT] Austria ..... A110/91

[51] Int. Cl.[5] ..... B26B 29/02; B26B 21/00

[52] U.S. Cl. ..... 30/43.92; 30/43.91; 30/43.7

[58] Field of Search ..... 30/43, 43.06, 43.08, 30/43.09, 43.91, 43.92, 43, 210, 43.7; 29/DIG. 37

[56] References Cited

U.S. PATENT DOCUMENTS

| | | | |
|---|---|---|---|
| 3,914,849 | 10/1975 | Martin | 29/DIG. 37 |
| 4,167,060 | 9/1979 | Sakamoto | 30/43.92 |
| 4,240,200 | 12/1980 | Bukoschek | 30/43.92 |
| 4,451,984 | 6/1984 | Shimazu | 30/43.92 |
| 4,493,149 | 1/1985 | Tanahashi et al. | 30/43.92 |
| 4,660,283 | 4/1987 | Yasunaka | 30/43.92 |
| 4,719,698 | 1/1988 | Nenomiya et al. | 30/43.92 |
| 4,813,136 | 3/1989 | Piber et al. | 30/43.92 |

*Primary Examiner*—Douglas D. Watts
*Assistant Examiner*—Paul M. Heyrana
*Attorney, Agent, or Firm*—Ernestine C. Bartlett

[57] ABSTRACT

An electric shaver (1) is provided comprising a housing (2), a shaving head (5) comprising a shaving foil (7) and a cutter assembly (8) with cutter lamellae (19), and a motor (23) of the rotary type as well as a transmission mechanism (31) acting between the motor (23) and the cutter assembly (8) in order to convert the rotation of the motor shaft (30) into a reciprocating movement to the drive a cutter assembly (8), the motor (23) having a nominal operating speed between 8000 and 10,000 revolutions per minute, wherein the motor (23) is covered with a sheath (32) of an elastic material, the transmission mechanism (31) comprises at least one balancing mass (52), and each of the cutter lamellae (19) of the cutter assembly (8) is provided with an indentation (57, 58) in each of its two side faces (55, 56) which are each bounded by a cutting edge (53, 54), which indentation extends parallel to the cutting edge (53, 54), and exhibits a cutting angle ($\beta$) smaller than 90° at both its cutting edges (53, 54).

10 Claims, 3 Drawing Sheets

ELECTRIC SHAVER

FIELD OF THE INVENTION

The invention relates to an electric shaver comprising a housing, a shaving head connected to the housing and comprising a shaving foil and a cutter assembly which comprises a plurality of cutter lamellae, which cutter assembly is reciprocable parallel to a direction of movement and cooperates with the shaving foil, a motor of the rotary type secured in the housing and having a specific nominal operating speed, and a transmission mechanism which is coupled to the motor shaft of the motor to convert the rotation of the motor shaft into a reciprocating movement and which is coupled to the cutter assembly for the reciprocating drive of this assembly.

BACKGROUND OF THE INVENTION

Such a shaver as defined in the opening paragraph is known, for example from DE-PS 27 49 936. The shaver employs a motor whose nominal operating speed is not specified in DE-PS 27 49 936. The nominal operating speed is to be understood to mean the speed of the motor when it drives the cutter assembly which cooperates with the shaving foil while no shaving takes place, i.e. while no hairs are severed. In most prior-art electric shavers the nominal operating speed of the motors used in these shavers lies at the most in a range of from 6500 to 7500 revolutions per minute. Such a maximum nominal operating speed, which is in a directly proportional relation to the oscillating frequency of the cutter assembly, relatively limits the shaving performance attainable with these shavers, which in its turn depends directly on the oscillating frequency of the cutter assembly. Recently some shavers have become known whose motors have a nominal operating speed in excess of the range of 6500 to 7500 r.p.m. in order to improve the shaving performance but in which no or inadequate steps have been taken to reduce noise and vibrations, so that these shavers are comparatively noisy in operation and produce comparatively strong vibrations. In a way comparable with these shavers the motor of the shaver known from DE-PS 27 49 936 is also secured directly in the housing of the shaver without any noise-reduction measures, so that in particular at a higher motor speed an undamped transmission of structure-borne noise from the motor to the housing is possible and occurs. Moreover, in the shaver known from DE-PS 27 49 936 the motor shaft of the motor can drive a transmission mechanism in which no measures have been taken to reduce vibrations of the shaver housing which originate in this mechanism, so that in particular at a higher motor speed comparatively strong housing vibrations may occur. Finally, the shaver in accordance with DE-PS 27 49 936 has a cutter assembly with conventional smooth-walled cutter lamellae, in which no steps have been taken to improve the cutting action and to reduce the housing vibrations and shaving-foil vibrations caused by the shaving actions and the shaving noise produced by such vibrations, so that in particular at a higher motor speed these vibrations van be comparatively strong and the shaving noise produced thereby can be comparatively loud.

SUMMARY OF THE INVENTION

An object of the invention is to improve a shaver of the type defined in the opening paragraph in such a manner that a better shaving performance is obtained with a minimal noise production and minimal vibrations of the shaver housing. To this end the invention is characterized in that the motor has a nominal operating speed in a range between 8000 and 10,000 revolutions per minute, the motor is covered with a sheath of an elastic material which at least partly surrounds the motor and which is situated at least at the location of all the contact areas between the motor and the housing provided for the motor on the housing, the transmission mechanism comprises at least one balancing mass which performs a movement in phase opposition to the movement performed by at least a part of the transmission mechanism, and each of the cutter lamellae of the cutter assembly is provided with an indentation in each of its side faces which are each bounded by a cutting edge, which indentation extends parallel to and up to the cutting edge, and exhibits a cutting angle smaller than 90° at both its cutting edges. As a result of the use of a motor having a nominal operating speed in the range between 8000 and 10000 r.p.m. the oscillation frequency of the cutter assembly is increased by an order of magnitude of 10% to 30% in comparison with many prior-art shavers, so that the number of cutting actions performed per unit of time and per hair-entry aperture in the shaving foil is substantially larger, yielding a distinct improvement of the shaving performance of a shaver equipped with such a motor. By providing the motor with a sheath of an elastic material the transmission of structure-borne noise from the motor to the housing is strongly damped despite the comparatively high nominal operating speed, which is advantageous in view of a minimal noise production of such a shaver. The use of at least one balancing mass in the transmission mechanism of the shaver guarantees that in spite of the comparatively high nominal operating speed of the motor the vibrations originating in the transmission mechanism and occurring in the shaver housing are minimized, which is advantageous in order to minimize the mechanical vibrations to which all the shaver parts and all the mechanical connections in the shaver are subjected and to improve the shaving comfort for the user. The provision of a cutter assembly comprising cutter lamellae indented at both sides results in an improved shaving performance owing to the advantageous sharp cutting edge construction, so that despite the comparatively high oscillating frequency of the cutter assembly caused by the comparatively high nominal operating speed of the motor the reactive forces on the cutter lamellae and, consequently, on the cutter assembly are only relatively small, as a result of which despite the comparatively high nominal operating speed of the motor the housing vibrations and shaving-foil vibrations caused by the shaving actions are only very small and, consequently, in spite of the comparatively high nominal operating speed of the motor no undesired noise is produced by such vibrations. Only by taking all the steps mentioned and explained above, i.e. by the combination of all the characteristic features in accordance with the invention, which may each be regarded as known when taken separately, it is possible to produce a shaver which as a result of the comparatively high nominal operating speed of the motor provides an excellent shaving performance and owing to the other steps, in spite of the comparatively high nominal operating speed of the motor, produces only minimal noise and vibrations.

In such a shaver in accordance with the invention the transmission mechanism may comprise, for example, only a slightly oval eccentric cam disc which is connected to the motor shaft and which directly engages a rectangular opening in the cutter assembly. This means that an adequate clearance has to be provided between the eccentric cam disc and the recess but this is not favorable for a minimal noise production. It is found to be very favorable if the transmission mechanism comprises an eccentric cam which is connected to the motor shaft of the motor and comprises a drive pin which is off centered relative to the motor shaft, and a connecting rod which is rotatably connected to the drive pin of the eccentric cam substantially without lost motion, as well as a vibratory bridge which is reciprocable parallel to the direction of movement of the cutter assembly and is pivotally connected to the connecting rod, and to the eccentric cam and the vibratory bridge, which form parts of the transmission mechanism, at least one of said two parts is provided with a balancing mass. This has the advantage that a transmission substantially without lost motion is obtained, which particularly in the case of a comparatively high nominal operating speed of the motor is advantageous in view of a minimal noise production, and that at least one of the essential parts of the transmission mechanism has been provided with a balancing mass, so that the shaver housing exhibits substantially no vibrations caused by the transmission mechanism.

The balancing mass may be, for example, a substantially sector-shaped portion which projects laterally from and is integral with the eccentric cam. However, it is also found to be advantageous if the balancing mass is a circular disc connected to the eccentric cam and having a hole which is off centered from its axis, by means of which hole the disc is non-rotatably pressed onto the eccentric cam. This has the advantage that the balancing mass can be replaced simply in the case of modifications of the construction of the drive system of the shaver without the eccentric cam itself having to be replaced or modified.

The indentations in the cutter lamellae of the cutter assembly can be formed, for example, by means of a separate grinding operation. However, it is found to be very advantageous if the indentations of the cutter lamellae of the cutter assembly are formed by stamping. Cutter lamellae can be provided very simply with such stampings because this can be effected, for example, simultaneously with the formation of the cutter lamellae in practically a single operation by means of a customary combined cutting and stamping tool.

It is further found to be advantageous if each of the cutter lamellae of the cutter assembly has a cutting angle between 70° and 80° at its two cutting edges. This has the advantage that a satisfactory compromise is obtained between two conflicting requirements, i.e. minimizing the cutting angle in order to obtain sharp cutting edges and minimizing the depth of the indentations in order to maintain a high rigidity of the cutter lamellae.

BRIEF DESCRIPTION OF THE DRAWINGS

The invention will now be described in more detail on the basis of two embodiments shown in the drawings but to which the invention is not limited.

DETAILED DESCRIPTION OF THE PREFERRED

Figure 1:
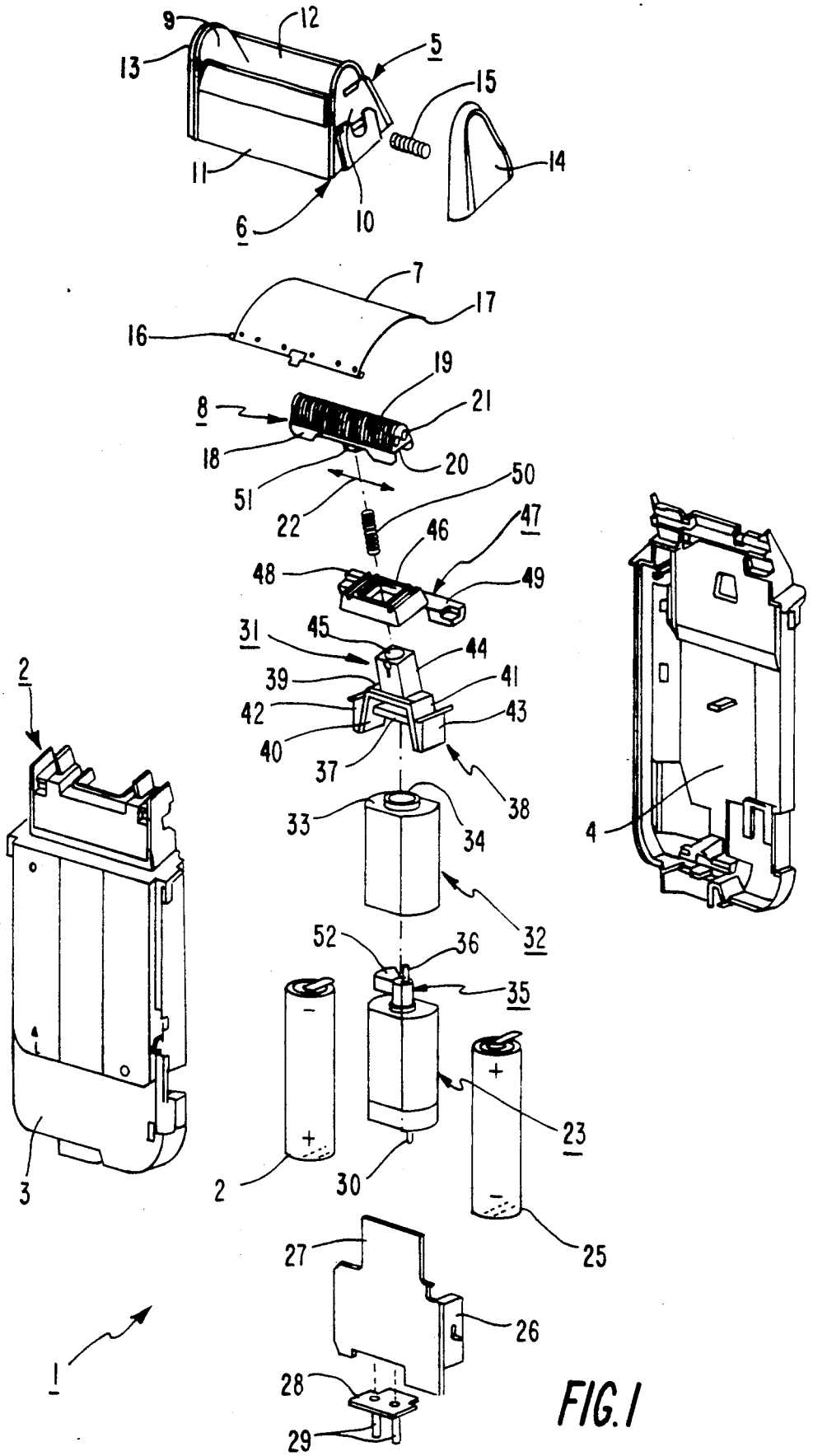
FIG. 1 is an exploded view showing an electric shaver in a first embodiment of the invention, which comprises between a drive motor and a cutter assembly a transmission mechanism with an eccentric cam arranged on the motor shaft of the motor and a vibratory bridge which can be driven by the eccentric cam via a connecting rod, the eccentric cam being provided with a balancing mass formed by a sector-shaped projection and the motor being enveloped in a rubber sheath which surrounds it completely.

FIG. 1 shows an electric shaver 1 having a housing 2 which basically comprises two shell-shaped housing halves 3 and 4 interconnected by connecting means, not shown. The shaver 1 comprises a shaving head 5 connected to the housing 2. The shaving head 5 substantially comprises a shaving-head frame 6, a shaving foil 7 mounted in the shaving-head frame 6, and a reciprocatingly drivable cutter assembly 8 which cooperates with the shaving foil 7 and which is often referred to as the internal shaving member.

The shaving-head frame basically comprises two side walls 9 and 10 and two longitudinal limbs 11 and 12 interconnecting the two side walls. At the outside the two side walls 9 and 10 are each provided with a side cover 13 and 14 respectively, which is pivotably attached to the respective side wall 9 or 10, a pressure spring being arranged between each side wall 9 or 10 and the relevant side cover 13 or 14, FIG. 1 showing only a pressure spring 15. Each side cover 13 or 14 is constructed as a push-button which can be pivoted against the load exerted by the pressure spring in order to release latching means which secure the shaving-head frame 6 to the housing 2.

The shaving foil 7 is constructed as a shear foil having multiple adjacent hair-entry apertures of small diameter which are separated from one another by narrow webs. At its two longitudinal edges the shear foil 7 is connected to reinforcement strips 16 and 17 by means of which the shear foil 7 is secured in the shaving-head frame 6. When the shear foil 7 is mounted in the shaving-head frame 6 the foil assumes a vaulted shape.

The cutter assembly 8 which cooperates with the shear foil 7 basically comprises a frame-shaped cutter-lamella holder 18 carrying a plurality of cutter lamellae 19. In addition to the cutter-lamella holder 18 two connecting tubes 20 and 21, which traverse the cutter lamellae 19, interconnect the cutter lamellae 19 to increase the resistance to bending of the cutter lamellae 19. At the location of their cutting edges the cutter lamellae 19 have an arcuate shape, the arcuate shape resembling that of a hyperbolic cosine. Likewise, the shear foil 7 with which the cutter lamellae 19 engage have such a curvature resembling a hyperbolic cosine. The vaulted shear foil 7 guides the cutter assembly 8 so as to be movable substantially parallel to the direction of movement indicated by the double arrow 22.

For driving the cutter assembly 8 the shaver 1 comprises a motor 23 of the rotary type, which is mounted in the housing 2 by clamping it between the two housing halves 3 and 4. The motor 23 has a specific nominal operating speed. For the electrical power supply to the motor 23 the housing 2 accommodates two rechargeable batteries 24 and 25, which can be charged by means of a charging circuit comprising diagrammatically shown components 26 mounted on a printed circuit board arranged in the housing 2. For the connection of the charging circuit on the printed circuit board 27 to an electric power mains the shaver 1 comprises two connector pins 29 which project from a synthetic-resin-bonded paper plate 28, which are connected to the charging circuit in the interior of the shaver, and which are engageable with a connector of an external mains cord.

The motor 23 of the rotary type comprises a rotor, not shown, which is connected to a shaft 30 of the motor 23, of which shaft only the lower end portion is visible in FIG. 1. In order to convert the rotary movement of the motor shaft 30 into a reciprocating movement for reciprocating the cutter assembly 8 parallel to the direction of movement 22 the shaver 1 comprises a transmission mechanism 31 which is coupled to the motor shaft 30 and to the cutter assembly 8 for the reciprocating drive of the latter.

The present shaver 1 comprises a motor 23 having a nominal operating speed in a range between 8000 and 10,000 revolutions per minute, e.g., 9000 r.p.m., in order to obtain a high shaving performance of the shaver. The nominal operating speed is to be understood to mean the speed which the motor 23 has when it drives the cutter assembly 8 which cooperates with the shear foil 7 while no shaving takes place, i.e. no hairs are being severed.

Moreover, in the present shaver 1 the motor 23 is covered with a sheath 32 which encloses substantially the entire motor 23 and which is made of an elastic material, e.g., of rubber. The rubber sheath 32 comprises a cup-shaped part shown in FIG. 1, whose bottom wall 33 has an opening 34 through which the motor shaft 30 is passed with its upper end in FIG. 1, and a capping part, not shown in FIG. 1, which is integral with the cup-shaped part and which when the motor 23 is introduced into the rubber sheath 32 is swung away from the cup-shaped part and upon introduction is swung back towards the cup-shaped part. The rubber sheath 32 is situated at the location of all the contact areas between the motor 23 and the housing 2 provided for the motor 23 on the housing 2.

The transmission mechanism 31 in the present shaver 1 comprises an eccentric cam 35, which is connected to the upper end of the motor shaft 30 in FIG. 1 and which comprises a drive pin 36 which is off centered relative to the motor shaft 30, and a connecting rod 37 which is rotatably connected to the drive pin 36 of the eccentric cam 35 substantially without lost motion, as well as a vibratory bridge 38 which is reciprocable parallel to the direction of movement 22 of the cutter assembly 8 and which is pivotally connected to the right-hand end of the connecting rod 37 in FIG. 1. The vibratory bridge 38 comprises a substantially rigid bridge portion 39 which is pivotally connected to the connecting rod 37 and which is connected to two substantially rigid mounting arms 42 and 43 by means of two inclined pivotal limbs 40 and 41, which arms are secured to the housing 2 with their free ends. The bridge portion 39 has a prismatic projection 44 with a cylindrical blind hole 45. The projection 44 is passed through an opening 46 in a rubber seal 47 which is elastically yielding at least in the direction of movement 22. The rubber seal 47 is secured in the housing 2 by means of two laterally projecting arms 48 and 49 and serves for sealing the motor compartment in the housing 2 to preclude the ingress of severed beard hairs into the motor compartment of the housing 2. The cylindrical blind hole 45 in the projection 44 accommodates a pressure spring 50. Moreover, a coupling projection 51 on the cutter-lamella holder 18 of the cutter assembly 8 is interlocked with the projection 44, the coupling projection 51 and hence the entire cutter assembly being movable against the force of the pressure spring 50 in the longitudinal direction of the blind hole 45. The pressure spring 50 ensures that the cutter lamellae 19 of the cutter assembly 8 always correctly engage with the shear foil 7.

Figure 2:
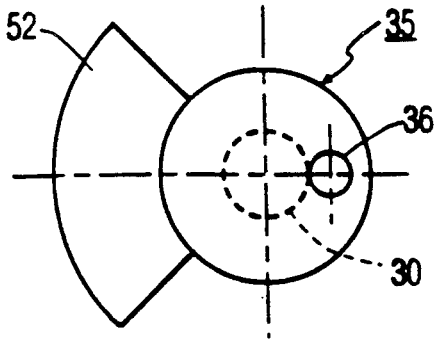
FIG. 2 shows in a plan view to a larger scale than FIG. 1 the eccentric cam with balancing mass of the shaver shown in FIG. 1.

The transmission mechanism 31 comprises a balancing mass 52 which performs a movement in phase opposition to the movement performed by a part of the transmission mechanism 31. As can be seen in FIGS. 1 and 2, the balancing mass 52 in the present case is a sector-shaped projection 35 which is integral with and projects laterally from the eccentric cam 35. The projection 52 forming the balancing mass is disposed diametrically opposite the drive pin 36 of the eccentric cam 35, so that the projection 52 performs a movement which is in phase opposition to or directed oppositely to the movement of the drive pin 36 of the eccentric cam 35.

In the present shaver only the eccentric cam has been provided with a balancing mass. However, in addition or instead, the vibratory bridge may be provided with a balancing mass, or alternatively the mass is arranged on a second vibratory bridge which reciprocates in phase opposition to the vibratory bridge driving the cutter assembly.

Figure 3:
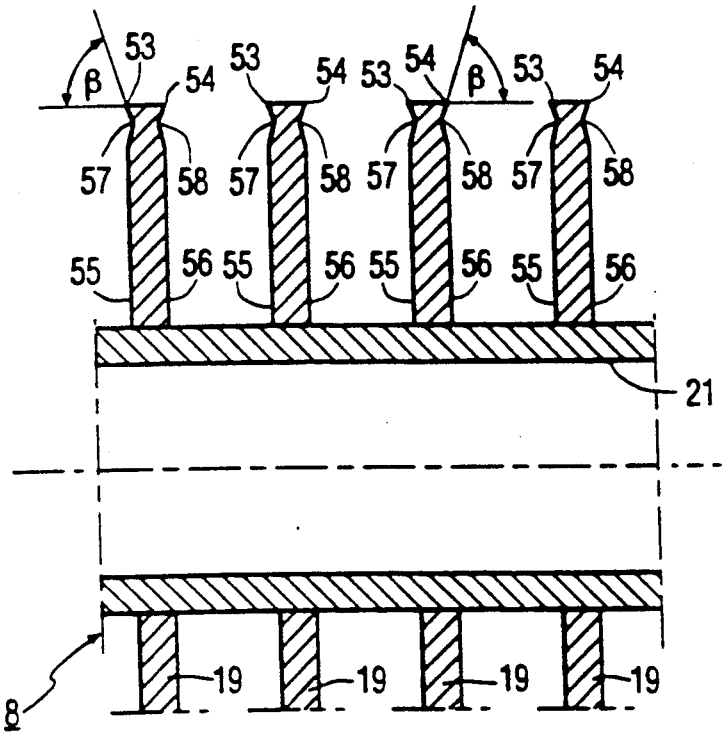
FIG. 3 shows in an axial sectional view to a larger scale than FIG. 1, a part of the cutter assembly of the shaver shown in FIG. 1.

Moreover, as is shown in FIG. 3, each of the cutter lamellae 19 of the cutter assembly 8 of the shaver in FIG. 1 is provided with an indentation 57 or 58 in each of its side faces 55 and 56 which are bounded by cutting edges 53 and 54 respectively, which indentations extend parallel to and up to the cutting edges 53 and 54 respectively and are consequently also arcuate, and as a result of these indentations 57 and 58 it exhibits a cutting angle $\beta$ smaller than 90° at both its cutting edges 53 and 54. The indentations 57 and 59 are simply formed by stamping, which during manufacture of the cutter lamellae is possible simultaneously with cutting of the cutter lamellae by means of a combined cutting and stamping tool. As can be seen in FIG. 3, each of the cutter lamellae 19 of the cutter assembly 8 has a cutting angle $\beta$ between 70° and 80°, in the present case 72°, at its two cutting edges 53 and 54.

The use of a motor 23 with such a high nominal operating speed of 9000 r.p.m. results in a distinctly higher shaving performance than obtained with most prior-art shavers. By covering the motor with a rubber sheath the transmission of structure-borne noise from the motor to the housing is strongly damped despite the high nominal operating speed, which is advantageous in view of a minimal noise production. The use of at least one balancing mass on the eccentric cam guarantees that in spite of the high nominal operating speed of the motor the vibrations originating in the eccentric cam drive remain small, which is advantageous in order to minimize the vibrations to which the shaver is subjected and to make it more convenient for the user to hold the shaver. The provision of cutter lamellae indented at both sides results in sharp cutting edges and consequently a very good cutting action, so that despite the high oscillating frequency of the cutter assembly owing to the high nominal operating speed of the motor the reactive forces on the cutter lamellae and, consequently, on the cutter assembly are only small, as a result of which despite the high nominal operating speed of the motor the housing, shaving-head and shear-foil vibrations caused by the cutting actions are only very small and, consequently, no undesired noise caused by such vibrations is perceptible. By taking all the steps mentioned and explained above it is possible to obtain a shaver which has an excellent shaving performance and a particularly vibration-free and silent operation.

Figure 4:
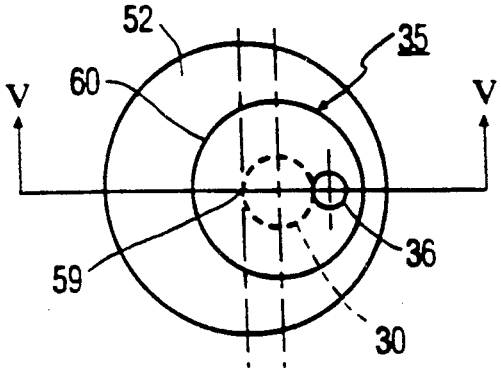
FIG. 4 in the same way as FIG. 2 shows an eccentric cam of a shaver in accordance with a second embodiment of the invention, in which the balancing mass is constituted by a separate disc which is off-centered relative to and connected to the eccentric cam.
Figure 5:
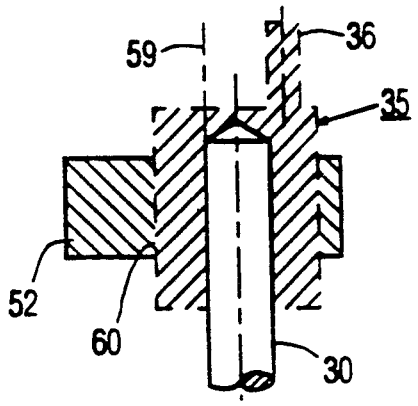
FIG. 5 shows the eccentric cam with balancing mass in a sectional view taken on the line V—V in FIG. 4.

FIGS. 4 and 5 show a part of a second embodiment of a shaver. FIGS. 4 and 5 show the motor shaft 30 of a motor of this shaver. An eccentric cam 35, which is rotationally locked to the motor shaft 30, comprises a drive pin 36 and is provided with a balancing mass 52. The balancing mass is a separate part formed by a circular disc 52 which is connected to the eccentric cam 35 and has a hole 60 which is off-centered from its axis 59, by means of which hole the disc 52 is non-rotatably pressed onto the eccentric cam 35. This enables the balancing mass 52 to be replaced in a simple manner without the need to replace the eccentric cam 35.

Figure 6:
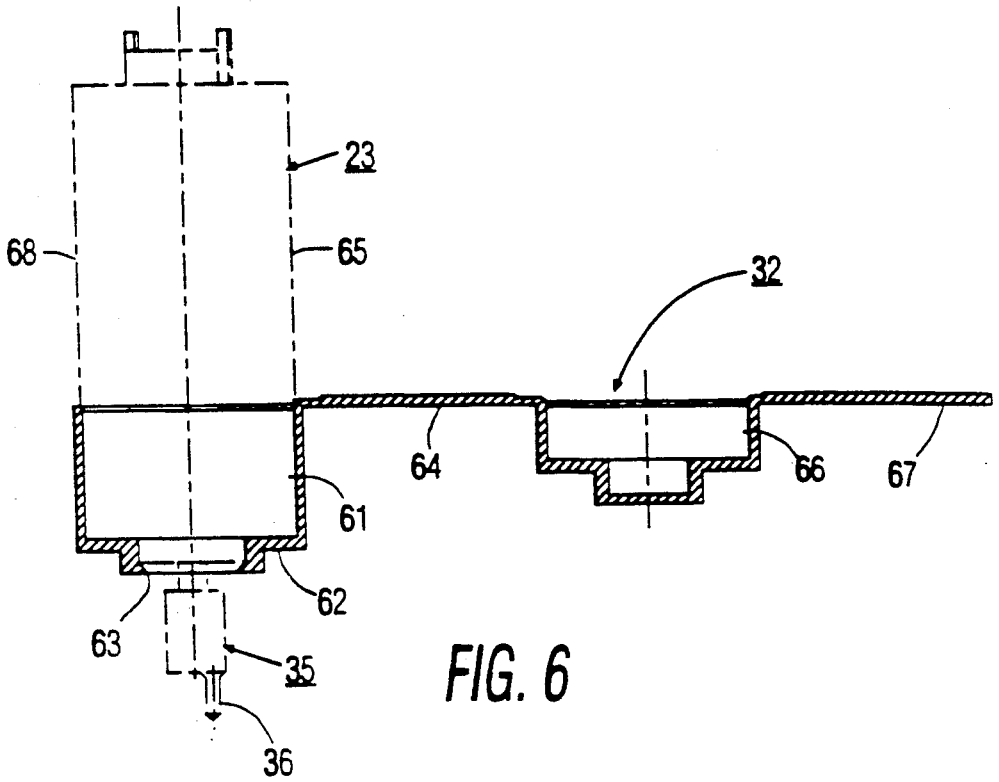
FIG. 6 is an axial sectional view of a rubber sheath for covering the motor of the shaver in accordance with the second embodiment of the invention, the rubber sheath being shown in the shape which it assumes after its manufacture when it does not yet cover the motor.

FIG. 6 shows the rubber sheath 32 for the motor 23 of the second embodiment of the shaver, the motor being represented diagrammatically in dash-dot lines. The rubber sheath 32 now comprises a first cup-shaped portion 61 into which the end of the motor 23 which faces the eccentric cam 35 of the shaver is introduced, as is shown in FIG. 6 where the eccentric cam 35 has not yet been provided with the balancing mass 52 shown in FIGS. 4 and 5. In its bottom wall 62 the first cup-shaped portion 61 has a hole 63 through which the motor shaft 30 of the motor 23 with the eccentric cam 35 extends. The first cup-shaped portion 61 is connected to a side portion 64 which projects laterally from this cup-shaped portion and which lies against a side wall 65 of the motor 23 in the mounted condition of the rubber sheath 32. The side portion 64 is connected to a second cup-shaped portion 66, which covers the end of the motor 23 which is remote from the eccentric cam 35 in the mounted condition of the sheath 32. The second cup-shaped portion 66 is connected to another side portion 67 which projects laterally from this cup-shaped portion and which lies against a side wall 68 of the motor 23 in the mounted condition of the rubber sheath 32. Such a rubber sheath 32 has the advantage that it can be manufactured comparatively simply.

The invention is not limited to the two embodiments described above. Several modifications are possible within the scope of the invention, in particular with respect to the nominal operating speed of the motor, which may also be 10,000 r.p.m., the construction of the elastic sheath for the motor as regards its shape and material, the provision of balancing masses in the transmission mechanism between the motor and the cutter assembly, and the formation of the notches or indentations in the cutter lamellae.

I claim:

1. An electric shaver comprising a housing, a shaving head connected to the housing and comprising a shaving foil and a cutter assembly which comprises a multitude of cutter lamellae, which is reciprocable parallel to a direction of movement and which cooperates with the shaving foil, a motor of the rotary type secured in the housing and having a specific nominal operating speed, and a transmission mechanism which is coupled to the motor shaft of the motor to convert the rotation of the motor shaft into a reciprocating movement and which is coupled to the cutter assembly for the reciprocating drive of this assembly, wherein (1) the motor has a nominal operating speed in a range between 8000 and 10,000 revolutions per minute; (2) the motor is covered with a sheath of an elastic material which at least partly surrounds the motor and is situated at least at the location of all the contact areas between the motor and the housing provided for the motor on the housing; (3) the transmission mechanism comprises at least one balancing mass which performs a movement in phase opposition to the movement performed by at least a part of the transmission mechanism, and each of the cutter lamellae of the cutter assembly is provided with an indentation in each of its side faces which are each bounded by a cutting edge, which indentation extends parallel to and up to the cutting edge, and exhibits a cutting angle smaller than 90° at both its cutting edges.

2. An electric shaver as claimed in claim 1, wherein the transmission mechanism comprises an eccentric cam which is connected to the motor shaft of the motor and comprises a drive pin which is off-centered relative to the motor shaft, and a connecting rod which is rotatably connected to the drive pin of the eccentric cam substantially without lost motion, and a vibratory bridge which is reciprocable parallel to the direction of movement of the cutter assembly and is pivotally connected to the connecting rod, the eccentric cam and the vibratory bridge, which form parts of the transmission mechanism, at least one of said two parts is provided with a balancing mass.

3. An electric shaver as claimed in claim 2, wherein the balancing mass is a circular disc connected to the eccentric cam and having a hole which is off-centered from its axis, by means of which hole the disc is non-rotatably pressed onto the eccentric cam.

4. An electric shaver as claimed in claim 3 wherein the indentations of the cutter lamellae of the cutter assembly are formed by stamping.

5. An electric shaver as claimed in claim 3 wherein each of the cutter lamellae of the cutter assembly has a cutting angle between 70° and 80° at its two cutting edges.

6. An electric shaver as claimed in claim 2 wherein the indentations of the cutter lamellae of the cutter assembly are formed by stamping.

7. An electric shaver as claimed in claim 2 wherein each of the cutter lamellae of the cutter assembly has a cutting angle between 70° and 80° at its two cutting edges.

8. An electric shaver as claimed in claim 1, wherein the indentations of the cutter lamellae of the cutter assembly are formed by stamping.

9. An electric shaver as claimed in claim 8 wherein each of the cutter lamellae of the cutter assembly has a cutting angle between 70° and 80° at its two cutting edges.

10. An electric shaver as claimed in claim 1, wherein each of the cutter lamellae of the cutter assembly has a cutting angle between 70° and 80° at its two cutting edges.

* * * * *